United States Patent [19]

Foerstner

[11] 4,053,731

[45] Oct. 11, 1977

[54] MICROWAVE ENERGY OVEN SEAL

[75] Inventor: Richard A. Foerstner, Iowa City, Iowa

[73] Assignee: Amana Refrigeration, Inc., Amana, Iowa

[21] Appl. No.: 647,685

[22] Filed: Jan. 8, 1976

Related U.S. Application Data

[63] Continuation of Ser. No. 479,379, June 14, 1974, abandoned.

[51] Int. Cl.[2] ..... H05B 9/06

[52] U.S. Cl. ..... 219/10.55 D; 174/35 GC

[58] Field of Search ..... 219/10.55 D, 10.55 F, 219/10.55 A, 10.55 R; 174/35 R, 35 GC; 333/95 R, 98 R

[56] References Cited

U.S. PATENT DOCUMENTS

| | | | |
|---|---|---|---|
| 3,584,177 | 6/1971 | Bucksbaum | 219/10.55 |
| 3,668,357 | 10/1970 | Kobayashi | 219/10.55 D |
| 3,678,238 | 7/1972 | Yasuoka et al. | 219/10.55 D |
| 3,745,226 | 7/1973 | Nichols et al. | 219/10.55 |
| 3,767,884 | 10/1973 | Osepchuk et al. | 219/10.55 |
| 3,809,843 | 5/1974 | Takayama | 219/10.55 D |

*Primary Examiner*—Arthur T. Grimley
*Attorney, Agent, or Firm*—M. D. Bartlett; J. D. Pannone; H. W. Arnold

[57] ABSTRACT

An energy seal for microwave oven apparatus having a first energy responsive structure disposed adjacent to a first energy propagation path commencing at the peripheral gap between the oven access opening and door assembly walls. A second structure responsive to the oven operating frequency is disposed adjacent to the output end of a second energy propagation path communicating with said first path. In one embodiment a conductive frame trim member forms a second choke-type structure together with underlying door assembly components of a nonconductive plastic material. The energy seal structures may also incorporate a slotted wall arrangement of the type disclosed in U.S. Pat. No. 3,767,884 to Osepchuk et al, issued Oct. 23, 1973.

15 Claims, 6 Drawing Figures

MICROWAVE ENERGY OVEN SEAL

This is a continuation of application Ser. No. 479,379, filed June 14, 1974 (now abandoned).

BACKGROUND OF THE INVENTION

1. Field of the Invention

The invention relates to energy seals for microwave oven apparatus.

2. Description of the Invention

Microwave ovens are widely used in the preparation of products for home and industry due to the rapid heating times resulting from the so-called dielectric heating phenomenon. The energy source typically employed for such apparatus is the magnetron of the type described in the text "Microwave Magnetrons", Vol. 6, Radiation Laboratory Series, by G. B. Collins, McGraw-Hill Book Company, Inc., 1948. The high frequency radiated within an oven enclosure is uniformly distributed by such means as mode stirrers to heat the load by molecular friction resulting from the absorbed energy oscillations. In such apparatus the enclosure dimensions are substantially greater than a free space wavelength of the operating frequency. The allocated frequencies for such apparatus are assigned by regulatory bodies such as the Federal Communication Commission and may be either 915 ± 13 MHz or 2450 ± 50 MHz in the industrial, scientific and medical band of the electromagnetic energy spectrum. The term "microwaves" is intended to define electromagnetic energy radiation in that portion of the spectrum having wavelengths in the order of 1 meter to 1 millimeter and frequencies in excess of 300 MHz.

Safety standards have been established by regulatory agencies such as the Department of Health, Education and Welfare and the American National Standards Institute for the control of the amount of energy leakage around the door enclosing the access opening to the oven enclosure. In the prior art numerous energy seals have evolved including metal-to-metal contacting arrangements shown, for example, in such U.S. Pat. Nos. as 2,956,143 issued to L. H. Shall, 2,958,754 issued to D. H. Hahn and 3,448,232 issued to J. Kluck. Other types of prior art energy seals include reentrant electrical choke arrangements having dieletric bodies disposed within a choke cavity to provide paths of least resistance for energy leaking along the peripheral gap defined between the door and access opening walls. Examples of the reentrant choke-type energy seals include U.S. Pat. Nos. 3,182,169 issued to R. Ironfield, 3,584,177 issued to A. Bucksbaum and the slotted-type energy seal embodying the teachings of 3,767,884 issued to J. Osepchuk et al.

The metal-to-metal type energy seals are subject to loss of effectiveness due to mechanical variations after long periods of use and problems of electrical arcing when spaces develop between the contacting metal surfaces. The choke-type arrangements are perhaps the most effective since the dimensions are selected to be frequency responsive to result in the reflection of a low impedance defined by a terminating wall at the point of origin of the escaping energy approximately one-half a wavelength away. Continual testing and experimentation with energy seals for microwave ovens has been required to improve such structures and to meet even higher safety standards. One area that has always been of concern is the difficulty in controlling the dimensions of choke-type seals particularly since close mechanical tolerances must be maintained during production. Variances in the dielectric bodies within the choke cavity as well as the spacings between the choke cavity and oven access opening walls defining a peripheral gap have been observed to lead to energy leakage on some sides at a higher level than the remaining sides of overall peripheral gap. As an additional safety factor, therefore, microwave ovens are provided adjacent the outer edge of the door with secondary energy absorbing structures of a plastic material loaded with carbon, graphite, ferrites or other lossy materials.

In addition to the enumerated prior art patents, numerous additional embodiments have evolved in the microwave heating art dealing with additional structures for preventing energy from escaping from the oven enclosure. Examples of such art include U.S. Pat. No. 3,668,357 issued to K. Kobayashi which discloses a second microwave cavity to prevent passage of the second harmonic frequency component of the energy, U.S. Pat. No. 3,544,751 issued to Valles which discloses projecting peripheral access opening walls which extend within channels provided in the door panel to provide a spacing of less than one-tenth of a wavelength of the operating frequency, and U.S. Pat. No. 3,249,731 issued to S. Johnson which provides a tandem arrangement of two quarter wave chokes at the microwave operating frequency.

With the desire for maintaining higher safety standards, it is necessary to provide new and improved energy seals which will cope with the dimensional problems, bearing in mind the need for simplicity and low cost.

SUMMARY OF THE INVENTION

In accordance with the teachings of the invention, a microwave oven energy door seal is provided having a first energy responsive structure disposed in close proximity to the input to the peripheral gap forming a first energy propagation path between the walls of the door assembly and the peripheral walls defining the oven access opening. This structure may be of the Ironfield reentrant choke type having a cavity length which is frequency responsive to reflect a short circuit at the entrance to the peripheral gap and prevent the escape of substantially all energy. This choke structure may be provided in either the door frame assembly or the opening walls. The door assembly and the front peripheral access opening walls define a second path for the propagation of any escaping energy outside of the oven enclosure.

Spaced from the first choke-type energy responsive structure and along the second propagation path, a second energy responsive structure is provided in lieu of secondary lossy gaskets. The second structure, which may be of the choke type, comprises a reentrant cavity section dimensioned to similarly provide a substantially low impedance or short circuit at the outer edge of the door assembly and at the output end of the first path. In one embodiment a spacing of approximately an integral number of half wavelengths from the open end of the first choke cavity to the open end of the second cavity resulted in attenuation of substantially all energy at the operating frequency. In door assemblies having one side longer than the remaining sides, the same formula of an integral number of half wavelengths from choke cavity input end to input end would be applicable.

For the purpose of assisting in an understanding of the invention, the term "wavelength" is defined as the wavelength of the electromagnetic energy at the operating frequency of the apparatus transmitted through the energy propagation paths having a dielectric medium. The term "free space" precedes the term "wavelength" when the length of electromagnetic waves within the enclosure is to be described. Standing as well as nonstanding waves are capable of being supported within the energy propagation paths having the dielectric medium. Such waves have a real phase velocity and the term "real" is intended to refer to a wave which is not cut off from propagation and is capable of propagating without substantially decaying.

In an illustrative embodiment of the invention, a substantially L-shaped frame member is disposed so as to overlap the peripheral edges of plastic and conductive material components of a door assembly. The second structure may be disposed on one or more sides of the peripheral door edges. It has been noted that the disposition of the second energy responsive structure adjacent the door edge has substantially reduced any measured leakage, particularly, along the bottom edge of side-hinged door members. In the exemplary embodiment a nonconductive material available under the trade name LEXAN forms the inner door member and is combined with a metallic door ring member to provide for the dieletric loading along the first and second energy propagation paths forming the escape route for the microwave energy. Further, first or second or both reetrant choke wall members may be slotted as provided for in the referenced Osepchuk et al U.S. Pat. No. 3,767,884 to further suppress any energy leakage.

BRIEF DESCRIPTION OF THE DRAWINGS

Details of the illustrative embodiment of the invention will be readily understood after consideration of the following description and reference to the accompanying drawings, wherein.

DESCRIPTION OF THE PREFERRED EMBODIMENT

Figure 1:
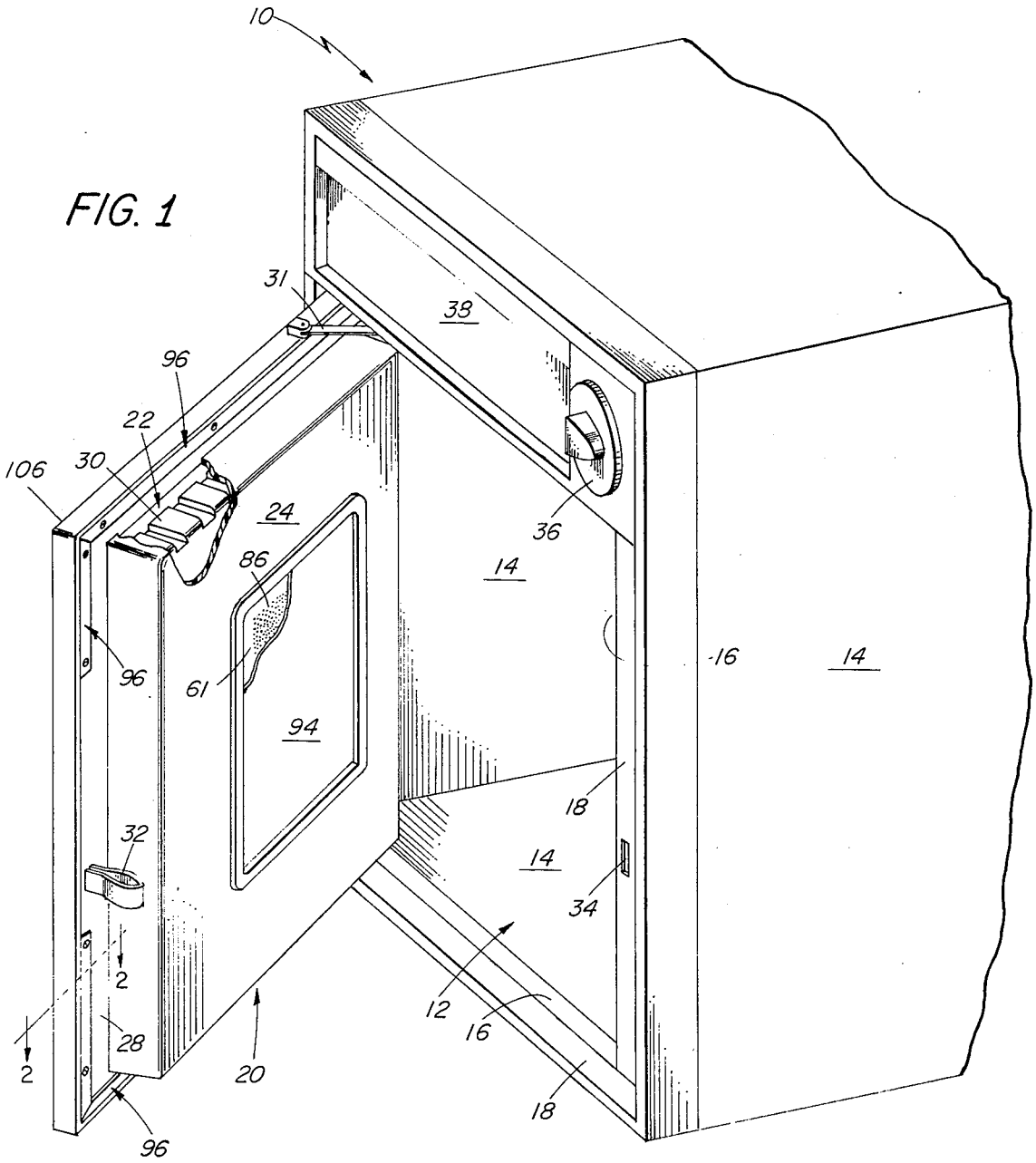
FIG. 1 is a perspective view of a portion of an illustrative microwave oven apparatus embodying the invention having a side-hinged door assembly.

Referring to FIG. 1 the microwave oven apparatus embodying the invention is shown comprising a body member 10 having an enclosure 12 defined by walls 14 which may be of a conductive material such as aluminum or stainless steel, coated with a layer of a nonconductive material for ease in cleaning. An access opening is defined by peripheral walls 16. Front lateral walls 18 frame the opening and may be also coated of a nonconductive material. The door assembly 20 embodying the invention is side-hinged for enclosing the access opening when the apparatus is operative. The door assembly comprises an energy seal having a first energy responsive structure 22 of the reentrant choke type disposed beneath an inner door member 24 of a nonconductive material, such as the plastic LEXAN. The inner door member 24 is also provided with a peripheral perpendicular extension wall 28 which is disposed in contact with opposite adjacent portions of the front lateral walls 18 when the door is closed. A wall of the choke structure 22 also forms a first energy propagation path with the access opening walls 16 and may be slotted to provide conductive fingers 30 arranged peripherally, as taught in the aforereferenced Osepchuk et al patent. The door assembly is controlled by lever arm 31 and an inner mechanism shown in detail in copending application of H. Rosenberry, Ser. No. 424,584, filed Dec. 13, 1973, now U.S. Pat. No. 3,863,045 and assigned to the present assignee. The door assembly 20 further includes a latch 32 adapted to mate with and engage slot 34 in a front lateral wall 18. A safety interlock switch is conventionally associated with the latch but has not been illustrated since such an arrangement is believed to be well known in the art. The microwave oven also includes a timer 36 mounted in the upper control panel 38.

Figure 4:
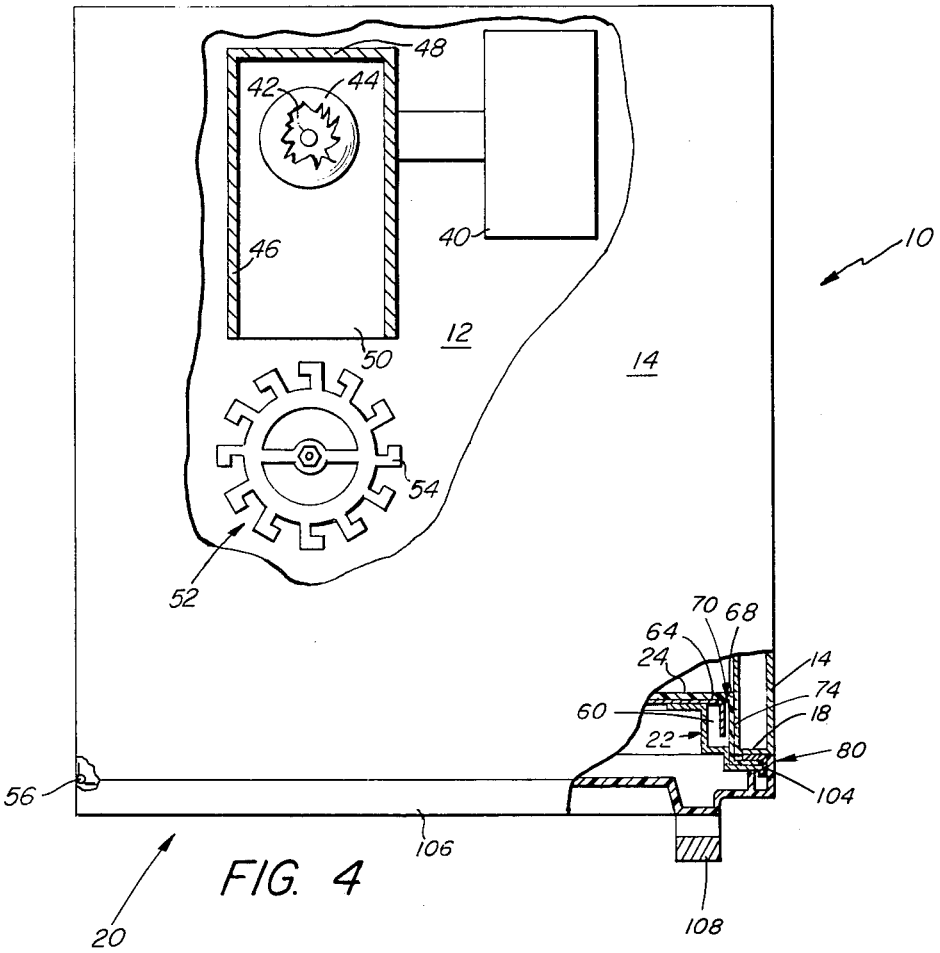
FIG. 4 is a plan view of the illustrative microwave oven apparatus with a portion of the top wall and one corner of the door assembly broken away and shown in cross section.

In FIG. 4 further details of structure within the body member 10 are disclosed with a portion of the top wall removed. The electromagnetic energy source, illustratively, a magnetron and the associated power supply and electrical controls are indicated generally by box 40. The energy is fed by means of a probe 42 within a dielectric dome 44 into a launching waveguide section 46 adapted to transmit energy to the enclosure at the allocated frequency, for example, 2450 MHz. The waveguide is terminated by wall 48 and the open end 50 communicates with the enclosure. The energy is distributed in a plurality of modes and may be cyclically varied by, illustratively a mode stirrer 52 having a plurality of paddles 54 which may be air-driven.

Figure 2:
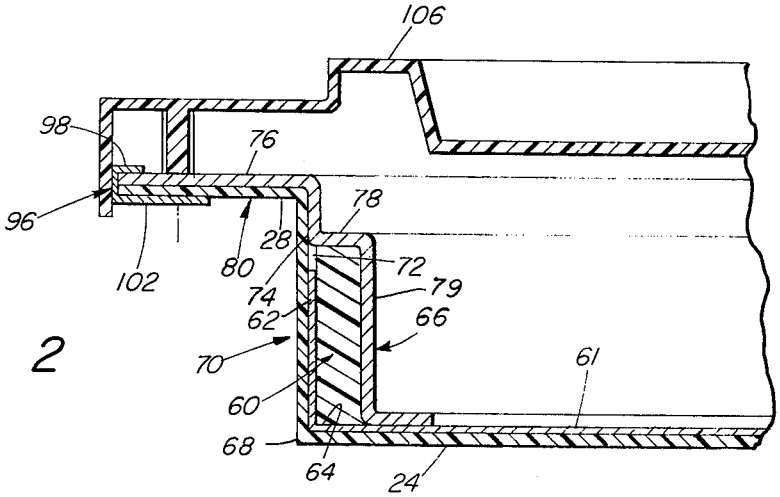
FIG. 2 is an enlarged fragmentary cross-sectional view taken along the line 2—2 in FIG. 1, viewed in the direction of the arrows.
Figure 3A:
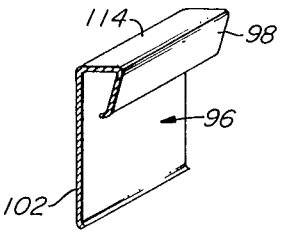
FIG. 3A is an enlarged view of a portion of the frame members of the door assembly embodying the invention.
Figure 3:
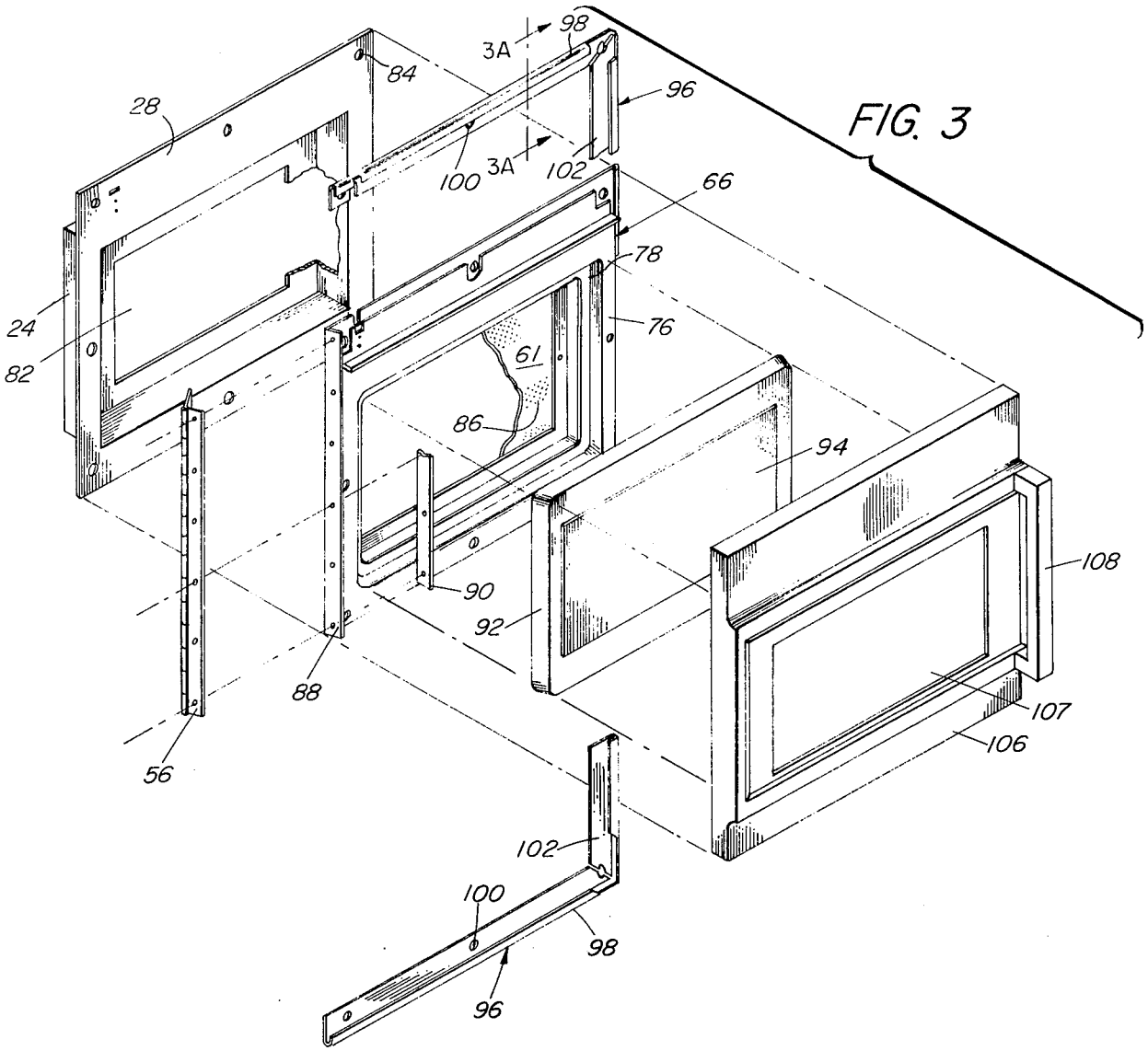
FIG. 3 is an exploded view of the component of an illustrative microwave oven door assembly embodying the invention.

Referring next to FIGS. 2, 3, 3A and 4 the details of the embodiment of the invention will be described. Door assembly 20 is movably supported by means of a hinge 56, as shown in FIGS. 3 and 4. The first choke-type energy structure 22 extends within the access opening, and the side walls of inner door member 24 contact the peripheral walls 16 framing the access opening. A choke cavity 60 is defined by wall extension 62 of panel member 61 forming a terminating end wall 64. The door weldment ring member 66 is stepped as at 78 and is secured to panel member 61 to provide the remaining sides of cavity 60. Gap 72 provides for ingress and egress of energy from choke structure 22. Common wall 62 also defines with the opposing adjacent peripheral walls 16 a first energy propagation path 70 forming substantially a parallel plate transmission line which is dielectric loaded by means of the inner door 24 material. Escaping energy originates at point 68 of the path 70 formed by the peripheral gap around the access opening between walls 16 and common choke wall 62. The electrical choke structure provides for the reflection of a low impedance from the terminating wall surface 64. A total electrical distance of approximately one-half a wavelength at the operating frequency is provided from the point 68 of origin of the escaping energy and the choke terminating surface 64 by making the distance along path 70 between the input point 68 and the center of choke gap 72 one quarter wavelength and by having the length of the choke equal to one-quarter of a wavelength. As a result, the low impedance provided by the short circuit provided by wall 64 results in a high impedance at the center of choke cavity gap 72. The ouput end of the first energy propagation path 70 is designated by the numeral 74.

As will be noted in FIG. 2 any energy escaping along the first propagation path 70 through output end 74 will traverse a second energy propagation path 80 formed by the opposing adjacent conductive lateral wall surfaces 18 and the perpendicular extension wall 76 of the door assembly ring member 66 formed after stepped portion 78.

Referring next to FIGS. 3 and 3A, the details of the novel door assembly will now be described. The plastic inner door member 24 is provided with opening 82 in models having a viewing window 94. Holes 84 are provided in all peripheral sides for fastening of the components of the overall door assembly. Abutting the inner door member 24 is a door weldment ring member 66 of a metallic material, such as aluminum, comprising the choke cavity wall portions 78 and perpendicular extension 79. Panel member 61 also of a conductive material is secured by metallurgical techniques such as spot welding to ring member 66 with the overhanging extension wall 62 forming a common wall with the choke cavity 60 and first energy propagation path 70. A plurality of perforations 86 in panel member 61 permit visual observation of the enclosure interior while preventing the escape of any electromagnetic energy radiation. If desired, panel member 61 may be fabricated of a solid opaque conductive material construction.

Door hinge 56 is secured to body walls 16 and the brace 88 of door weldment ring member 66. Tap strip 90 provides for fastening the hinge to brace 88 by means of sheet metal screws. A window member 92 of a plastic composition is provided with a transparent section 94 adapted to mate with opening 82 and abuts panel member 61 within ring member 66.

Trim strips 96 of a conductive material are formed as shown in FIG. 3A so that the shorter leg portion 98 of a substantially L-shaped configuration provides for a snug engagement of extension wall 76 of the door ring member 66 and the extension wall 28 of the inner door member 24. The combined structures forms a dielectric-loaded second energy responsive structure 104 of the choke-type with straight portion 102 dimensioned to have approximately a one-quarter electrical length at the operation frequency similar to choke wall 62 of the first structure 22. The width of the resultant choke cavity, however, is narrower than cavity 60. Trim members 96 are disposed adjacent the top side and a portion of the vertical latch side of the door assembly, as well as, the bottom side and latch side. Holes 100 provide for alignment and attachment to the door assembly. In the illustrative embodiment the lateral extension walls 76 and 28 of the ring member 66 and inner door member 24, respectively, were dimensioned to provide a top side of approximately twice the length of the bottom and two vertical sides. Further details of the spacing and operation of the second energy responsive structure 104 will be discussed hereinafter. The door assembly is completed by an outer door member 106 having an opening 107 which mates with window member transparent section 94. A handle 108 provides for opening and closing the door assembly. The outer door is molded as a unitary assembly of a plastic material. Suitable fasteners, screws and the like for securing the overall door assembly as well as details of the door moving mechanism 31 have been omitted since they are well known or disclosed in the referenced pending patent application. In lieu of the opening 107, a solid panel (not shown) may be incorporated as a part of the overall outer door mold in ovens omitting the door viewing window.

Figure 5:
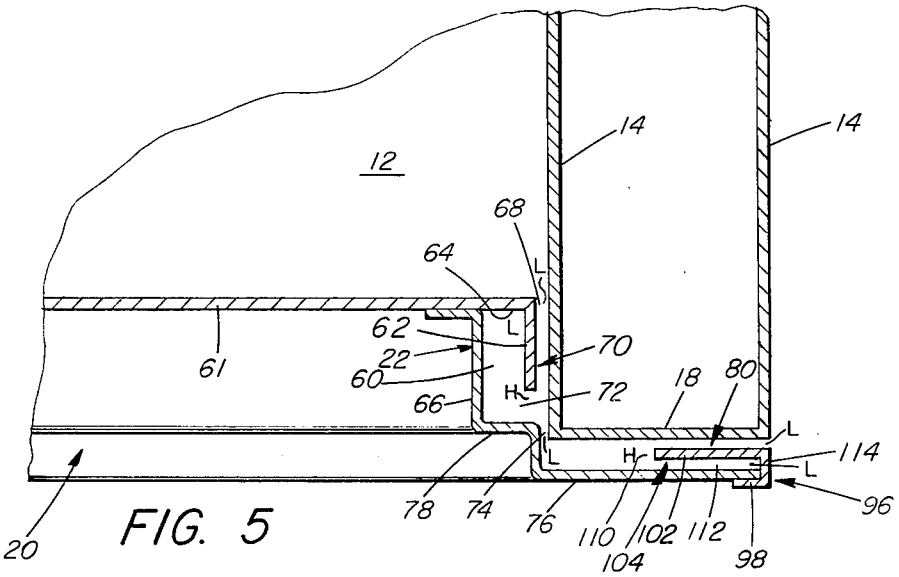
FIG. 5 is a diagrammatic representation of the embodiment of the invention.

Referring next to FIG. 5, further details of the first and second energy responsive structures 22 and 104 will be described as well as, the operation of the overall energy seal in the suppression of energy leakage along the first and second energy propagation paths 70 and 80. In the interest of a better understanding of the invention the dielectric components of the microwave oven body and door assembly 20 have been omitted in the diagrammatic representation of FIG. 5. It is understood that such dielectric materials extend substantially throughout the first and second energy propagation paths 70 and 80 as well as, choke cavity 60 and the second choke structure 104. The choke cavity gaps are formed adjacent the free extremity ends of the conductive common wall 62 in the first energy responsive structure 22 and is designated by the numeral 72. In the second energy responsive structure 104 the straight wall portion 102 of the door trim member 96 has substantially the same length as the common wall 62. All electrical wavelength distances discussed hereinafter will relate to the area adjacent to the free extremity end of the portion 102 designated by the numeral 110.

In accordance with the well known principles of choke-type energy seals, of which the Ironfield patent is an example, the choke dimensions are typically selected to provide for the reflection of the short circuit or low impedance at the conductive terminating wall 64 to the point 68 of origin of escaping energy entering the first energy propagation path 70 over a total overall distance of approximately one-half an electrical wavelength at the operating frequency. The choke cavity 60 has a length of approximately one-quarter of a wavelength from the terminating wall surface to the center of the choke gap 72. The low impedance at terminating wall 64 reflected within the choke cavity results in a high impedance point at the gap 72, as indicated by the symbol H. One-quarter of a wavelength from this point the escaping microwave energy at the operating frequency is choked by the reflection of the short circuit point of energy origin 68, as well as, the output end 74 of the path 70 which is also approximately one-quarter of a wavelength away from the center of the gap. At point 74 the symbol L indicates that the low impedance is present.

For more efficient suppression of substantially all of the energy leakage through the door and access opening peripheral gap, a second energy responsive structure 104 is provided with substantially similar energy reflecting choking response as the first structure 22. Substantial attenuation of any remaining energy leakage from the output end of the second choke structure 104 formed by the conductive trim members 96 into the outside environment will result. The combined lateral wall surfaces 76 of door ring member 66 and the conductive trim members 96 forms a choke cavity 112 and a terminating wall surface 114. The two energy responsive choke-type structures are, electrically coupled in series for the attenuation of substantially all energy transmitted through the energy propagation paths 70 and 80. The terminating wall surface 114 provides a low impedance L which is reflected substantially one-half of an electrical wavelength at the operating frequency to the output end of propagation path 80, also indicated by L. Adjacent the entrance 110 to the choke cavity 112 a high impedance H is present.

In accordance with the further teachings of the invention, the spacing of the high impedance point adjacent to the ends of the respective choke common wall members 62 and 102 is substantially an integral number of one-half electrical wavelengths at the operating frequency. This spacing enhances the effectiveness of the L point at the input and output ends of the coupled energy propagation paths 70 and 80, respectively. In the door assembly, similar to the one illustrated in FIG. 3 having the wider top portion, the same relative spacings of the H impedance points provided adjacent to the ends of the common wall members 62 and 102 is maintained. Hence, in this embodiment with the top portion approximately twice the length of the vertical side and bottom portions, the entrance 110 to the second energy responsive structure 104 is approximately twice the one-half wavelength spacing or one effective electrical wavelength of the energy of the operating frequency.

Numerous modifications, alterations and variations will be evident to those skilled in the art. For example, the first energy responsive structure 22 may be provided within the confines of the microwave oven enclosure walls 14 in place of the disposition along the peripheral walls of the door assembly 20. The foregoing description of an illustrative embodiment, therefore, is to be considered in its broadest aspects and not in a limiting sense.

I claim:

1. Heating apparatus comprising:

an enclosure;

means for energizing said enclosure with electromagnetic wave energy predominantly adjacent a predetermined operating frequency;

said enclosure comprising a wall member having an access opening communicating with said enclosure;

a door for closing said opening;

an energy escape seal comprising at least portions of said door and access opening peripheral walls and forming a propagation path for said energy extending from a first region adjacent to the interior of said enclosure and to the peripheral edges of said opening to a second region outside said seal;

said seal having a first dielectric loaded frequency responsive structure coupled to said path comprising first substantially low impedance means electrically spaced a distance substantially equal to an integral number of one-half wavelengths at said operating frequency from said first region and a second portion of said path communicating with the first path portion and defined at least in part by opposing adjacent wall surfaces of said door and wall members when said door is closed;

said second path portion terminating at said second region adjacent to the outer peripheral edges of said door;

a second dielectric loaded frequency responsive structure coupled to said second path comprising second substantially low impedance means electrically spaced from said second region by a distance substantially equal to an integral number of half wavelengths of said frequency; and said first and second frequency responsive structures being substantially resonant at said predetermined operating frequency and coupled electrically to said path at coupling regions in said path which are spaced apart along said path for reflecting low impedances to said first region at the operating frequency of said apparatus.

2. The apparatus according to claim 1 wherein said first and second frequency responsive structures each comprise a choke section member having a free extremity with said first and second energy propagation paths and having a cavity section terminating in a conductive surface.

3. The apparatus according to claim 2 wherein both said choke cavities have an average length substantially equal to an odd number of wavelengths of said operating frequency.

4. The apparatus according to claim 2 wherein the regions of coupling of said first and second choke sections to said path are spaced apart an average distance of substantially an integral number of one-half wavelengths of said operating frequency.

5. The apparatus according to claim 1 wherein said second energy propagation path portion and said second frequency responsive structure extend in a direction substantially perpendicular to said path and frequency responsive structure.

6. The apparatus according to claim 1 wherein said second frequency responsive structure comprises a conductive member electrically contacting at least one peripheral edge of said door.

7. The apparatus according to claim 6 wherein said conductive member comprises at least one substantially straight portion having an average length of substantially one-quarter of a wavelength at said operating frequency and separated from a conductive surface of said door by a solid dielectric.

8. The apparatus according to claim 1 wherein said first frequency responsive structure comprises a wall which is common with one wall of said path; and said common wall having means for inhibiting the transmission of energy at said frequency along said seal.

9. The apparatus according to claim 1 wherein said first frequency responsive structure comprises an electrical choke structure formed in said door and having portions extending within said access opening when said door is closed.

10. In combination:

a source of microwave energy;

an enclosure fed by microwave energy from said source and having interior dimensions substantially greater than the free space wavelength of the predominant frequency of said energy;

an access opening in said enclosure closed by a closure member;

a microwave energy seal comprising portions of the periphery of said access opening and said closure member forming a propagation path for said energy from the interior of said enclosure through said seal;

said path comprising a first transmission line section extending from the interior of said enclosure to a first region of coupling of said path to a first choke structure and a second transmission line section extending from said first coupling region to a second region of coupling of said path to a second choke structure; and said first and second choke structures being substantially resonant to the predominant microwave frequency of said source.

11. The combination according to claim 10 wherein said first transmission line section has an effective electrical length substantially equal to an odd number of quarter wavelengths of said frequency.

12. The combination according to claim 10 wherein said first transmission line section and said first choke structure have a common wall.

13. The combination according to claim 12 wherein said common wall contains slots.

14. The combination according to claim 13 wherein the spacing of said slots is selected to inhibit the propagation of energy in said seal along the periphery of said opening.

15. The combination according to claim 10 wherein said input transmission line section inhibits transmission of microwave energy at said frequency peripherally along said seal.

* * * * *